US009243433B2

(12) United States Patent
Hänsch

(10) Patent No.: US 9,243,433 B2
(45) Date of Patent: Jan. 26, 2016

(54) ROTATING DOOR WHICH IS DRIVEN SO AS TO BE SWIVELABLE AROUND A PIVOT

(71) Applicant: Holger Hänsch, Witten (DE)

(72) Inventor: Holger Hänsch, Witten (DE)

(73) Assignee: Dorma Deutschland GmbH, Ennepetal (DE)

( * ) Notice: Subject to any disclaimer, the term of this patent is extended or adjusted under 35 U.S.C. 154(b) by 0 days.

(21) Appl. No.: 14/326,678

(22) Filed: Jul. 9, 2014

(65) Prior Publication Data

US 2015/0013106 A1 Jan. 15, 2015

(30) Foreign Application Priority Data

Jul. 11, 2013 (DE) ..... 10 2013 213 574

(51) Int. Cl.
*E05F 11/00* (2006.01)
*E05D 7/00* (2006.01)
*E05F 15/614* (2015.01)

(52) U.S. Cl.
CPC ..... *E05D 7/00* (2013.01); *E05F 15/614* (2015.01); *Y10T 16/5377* (2015.01)

(58) Field of Classification Search
CPC ..... E05D 7/00; Y10T 16/5377; E05F 15/614
USPC ..... 49/333, 334, 339, 340, 341
See application file for complete search history.

(56) References Cited

U.S. PATENT DOCUMENTS

| | | | | | |
|---|---|---|---|---|---|
| 1,681,141 | A * | 8/1928 | Terhune | 74/606 R |
| 1,819,574 | A * | 8/1931 | Sheard | 74/450 |
| 2,098,284 | A * | 11/1937 | Fraser | 49/247 |
| 2,488,313 | A * | 11/1949 | Miskelly | 49/334 |
| 3,210,065 | A * | 10/1965 | Linder et al. | 49/137 |
| 4,057,208 | A * | 11/1977 | Andrews et al. | 246/125 |
| 5,680,728 | A * | 10/1997 | Moy | 49/324 |
| 6,553,717 | B2 * | 4/2003 | St. John et al. | 49/340 |
| 6,634,140 | B1 * | 10/2003 | Sellman | 49/340 |
| 7,785,220 | B2 * | 8/2010 | Ciavaglia et al. | 474/112 |
| 8,407,937 | B2 * | 4/2013 | Houser | 49/139 |
| 2006/0010771 | A1 * | 1/2006 | Houser et al. | 49/341 |
| 2010/0037527 | A1 * | 2/2010 | Bochen | 49/341 |
| 2011/0094160 | A1 * | 4/2011 | Houser | 49/31 |

* cited by examiner

*Primary Examiner* — Jerry Redman
(74) *Attorney, Agent, or Firm* — Cozen O'Connor

(57) ABSTRACT

An rotating door driven so as to be swivelable around a pivot of the rotating door includes a rotary bearing; a connection element having a driver piece configured to receive the pivot of the rotating door, the driver piece being mounted in the rotary bearing; and a drive connectable to the pivot of the rotating door in frictional engagement via the connection element.

9 Claims, 4 Drawing Sheets

ROTATING DOOR WHICH IS DRIVEN SO AS TO BE SWIVELABLE AROUND A PIVOT

BACKGROUND OF THE INVENTION

1. Field of the Invention

The present invention is directed to a rotating door driven so as to be swivelable around a pivot.

2. Description of the Related Art

In known rotating doors of this type, the drive also functions as an upper bearing location for the pivot of the rotating door. This requires a massive design of the drive housing and bearing with the result that corresponding drives have quite a large construction and a complicated design.

SUMMARY OF THE INVENTION

Therefore, it is an object of the present invention to provide a rotating door driven so as to be swivelable around a pivot in which the drive and the bearing only take up a small installation space and in which, further, the bearing can be realized inexpensively.

In a rotating door driven so as to be swivelable around a pivot, the above-stated object is met according to an aspect of the invention in that the pivot is received in a driver piece and this driver piece is mounted in a rotary bearing, and in that the drive can be connected to the pivot of the rotating door in frictional engagement via a connection element, which also comprises the driver piece. Because of the arrangement according to the invention, the pivot of the rotating door is decoupled from the drive and obtains its own bearing with the result that impacts from the movement of the door are not transmitted into the drive. Therefore, the drive can have a more slender constructional shape and a cost-optimized design. Further, the rotating door can be mounted independently from the drive so that the drive need not be connected to the pivot of the rotating door until later, so as to protect its components, for example, in the construction phase.

The connection element that connects the rotational pivot and the drive to one another is constructed substantially in the form of a flat, cylindrical disk according to an advantageous embodiment. According to a preferred embodiment, it is divided and comprises a bottom part and a top part.

The bottom part advantageously carries a stop for limiting the door movement, and the top part has an adapter piece for connecting to the drive.

In order to save on installation space, the bottom part and the top part can be joined in radial direction according to an advantageous further development. The bottom part and top part can accordingly be mounted in a radial direction, whereas conventional connection elements must generally be mounted axially and therefore require a larger installation space for mounting.

The bottom part and the top part are preferably connected to one another by two screws, which are arranged parallel to one another and which penetrate the connection element on both sides of its pivot.

According to an advantageous embodiment, the two screws are mounted in the top part via elastic buffers and can be screwed into the bottom part. This allows a radial and angular offset between the bottom part and the top part, the order of magnitude of which can be adjusted through the degree of preloading of the elastic buffer and the selected gap dimensions between the bottom part and top part.

According to a preferred embodiment, the driver piece is fastened to a support held at the bottom part in an exchangeable manner in order to carry out a simple adaptation to different diameters of the rotational pivot. Accordingly, a corresponding rotary bearing can be selected and used depending on the required diameter.

According to a preferred further development, the adapter piece is also fastened to a support held at the bottom part in an exchangeable manner. This also enables a simple adaptation to different drives.

The driver piece and/or the adapter piece can advantageously be held at the support by positive engagement/and or bonding engagement. Alternatively, the driver piece and/or the adapter piece can also be press fit in the support.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further details, features and advantages of the invention are given in the following description referring to the drawings. In the drawings.

DETAILED DESCRIPTION OF THE PRESENTLY PREFERRED EMBODIMENTS

The drawings substantially show only the drive and the connection element, while the rotating door and the pivot thereof have been omitted for the sake of clarity.

Figure 1:
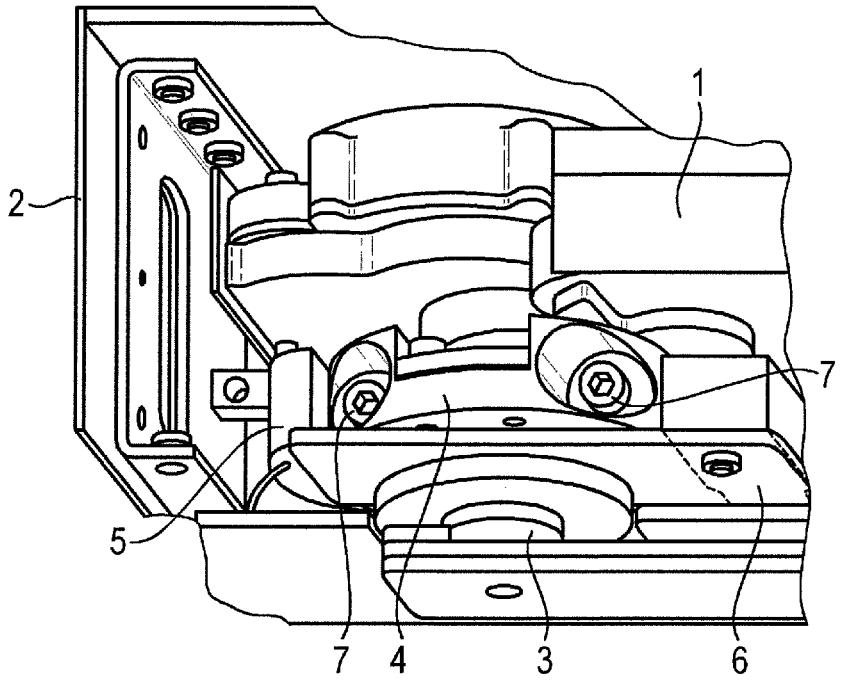
FIG. 1 is a view showing a rotating door swivelable around a pivot in the area of the bearing support thereof.
Figure 2:
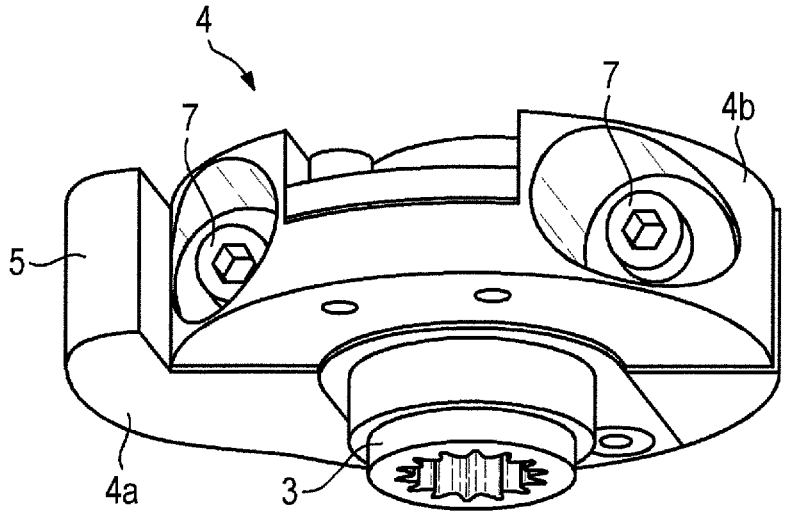
FIG. 2 is a perspective oblique bottom view of a connection element according to the invention.
Figure 3:
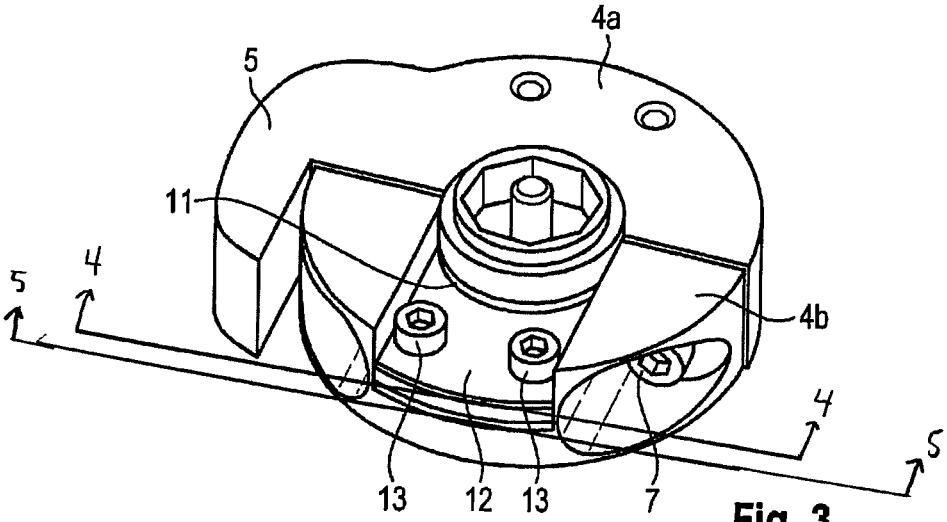
FIG. 3 is a perspective oblique top view of a connection element according to the invention.
Figure 4:
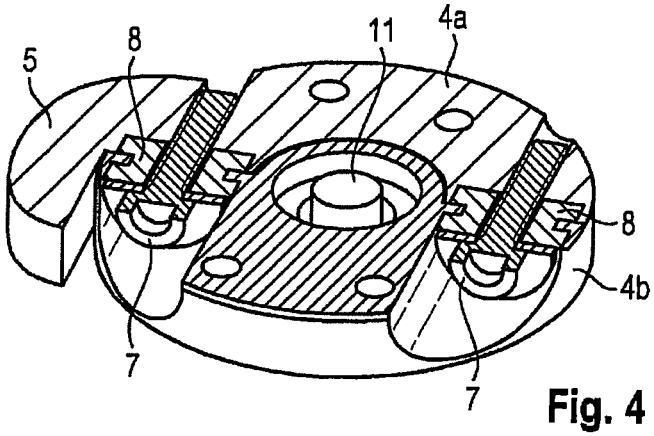
FIG. 4 is a section through the connection element according to the invention.
Figure 5:
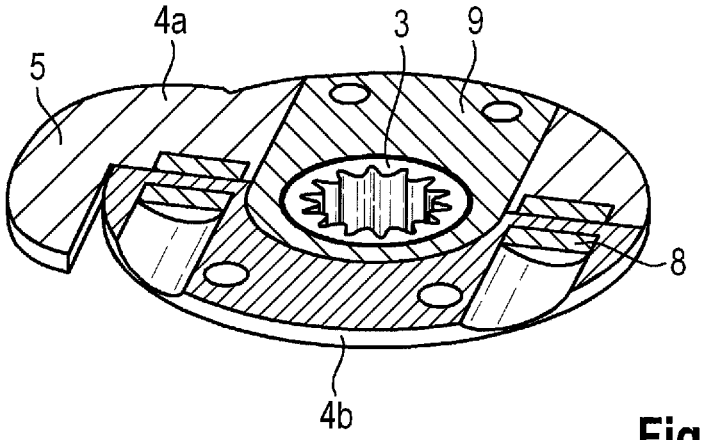
FIG. 5 is a further section through the connection element according to the invention.
Figure 6:
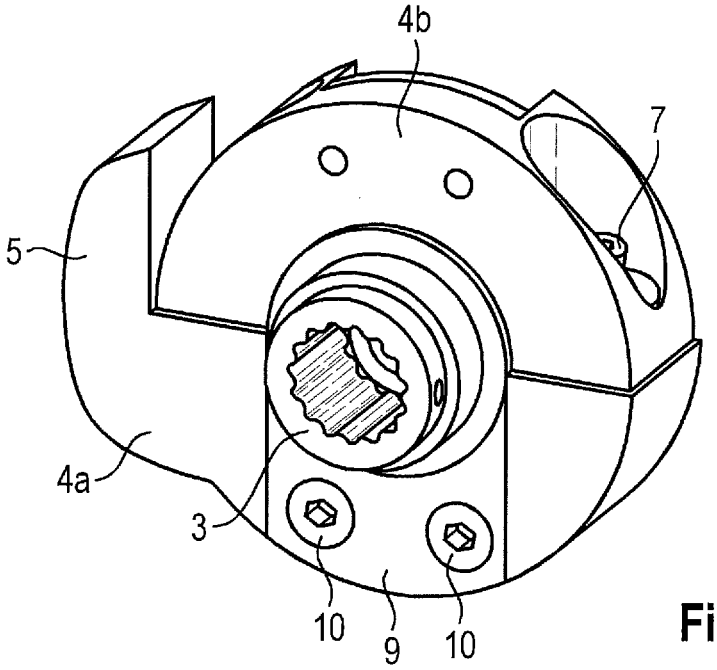
FIG. 6 is a view of the connection element according to the invention from below.
Figure 7:
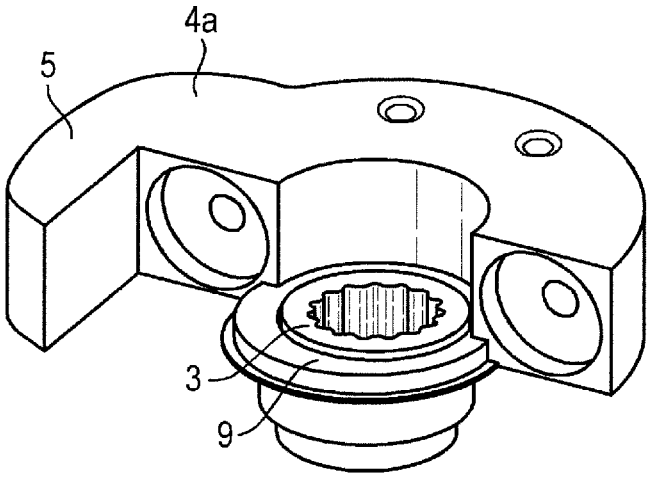
FIG. 7 is a view of the bottom part of the connection element according to the invention.
Figure 8:
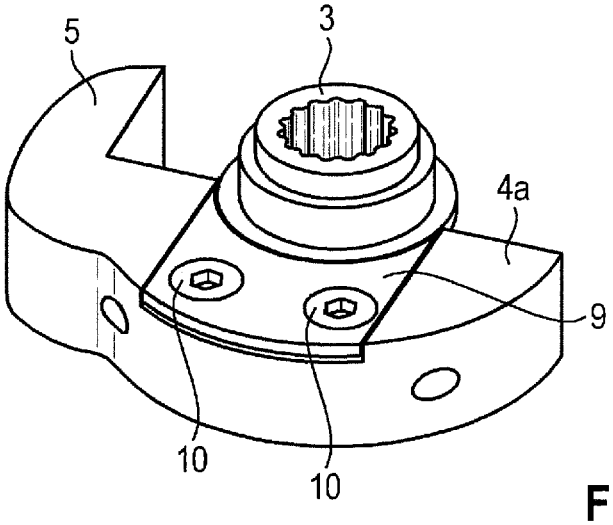
FIG. 8 is a further view of the bottom part of the connection element according to the invention.

FIG. 1 shows a drive 1 for a rotating door received in a housing 2. The pivot of the rotating door is mounted in a rotary bearing, not shown, which is independent from the drive 1. A driver piece 3, which serves to transmit a torque, is supported at the rotary bearing. A connection element 4, which couples the pivot of the drive to the pivot of the rotating door, is provided so that the drive 1 can move the rotating door.

The connection element 4, which is shown in various views and sections in FIGS. 2 to 8, substantially has the shape of a flat, cylindrical disk. This disk has a substantially tangentially extending stop 5 that cooperates with a stopper 6, which is arranged at the drive 1 or at the housing 2 thereof to limit the movement of the rotating door.

The connection element 4 is formed in a divided manner and comprises a bottom part 4*a* and a top part 4*b*. The bottom part 4*a* and the top part 4*b* are connected to one another via two screws 7, which are arranged parallel to one another and which penetrate the connection element 4 laterally of the pivot thereof. The screws 7 are supported in the top part 4*b* via elastic buffers 8 and can be screwed into the bottom part 4*a*. Due to this design, bottom part 4*a* and top part 4*b* can be joined in a radial direction.

The stop 5 and the driver piece 3 are arranged at the bottom part 4*a*. However, whereas the stop 5 is formed in one piece with the bottom part 4*a*, the driver piece 3 is received in a support 9, which is exchangeably mounted at the bottom part 4*a*. For example, the support 9 can be connected to the bottom part 4*a* via axially arranged screws 10.

An adapter piece 11, which serves to connect to the drive 1, is arranged at the top part 4*b*. The adapter piece 11 is likewise supported in a support 12 which is fastened to the top part 4*b* so as to be exchangeable, e.g., via axially arranged screws 13.

Due to the exchangeability of driver piece 3 and adapter piece 11, the connection element 4 can easily be adapted to different diameters of the pivot of the rotating door or of the drive pivot.

The driver piece 3 and/or the adapter piece 11 can be held by positive engagement and/or bonding engagement at the support 9 and 12, respectively. Alternatively, the driver piece 3 and/or the adapter piece 11 can also be press fit to the support 9 and 12, respectively.

The foregoing description of the present invention only serves for purposes of illustration and not for the purpose of limiting the invention. Various changes and modifications are possible within the framework of the invention without departing from the scope of the invention and equivalents thereof.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A connection element (4) for connecting a drive (1) to a rotating door to drive the rotating door so as to be swivelable around a pivot of the rotating door, the connection element (4) comprising:

a driver piece (3) configured to receive the pivot of the rotating door;

a bottom part (4*a*); and a top part (4*b*);

wherein:

the drive (1) is connectable to the pivot of the rotating door in frictional engagement via the connection element (4), the bottom part (4*a*) and the top part (4*b*) are connected to one another by two screws (7) arranged parallel to one another and which penetrate the connection element (4) on two sides thereof, and the two screws (7) are mounted in the top part (4*b*) by elastic buffers (8) and can be screwed into the bottom part (4*a*).

2. The connection element (4) according to claim 1, wherein the connection element (4) is in the form of a flat, cylindrical disk.

3. The connection element (4) according to claim 1, wherein the bottom part (4*a*) has a stop (5) configured to limit movement of the door, and the top part (4*b*) has an adapter piece (11) configured to connect the connection element (4) to the drive (1).

4. The connection element (4) according to claim 3, wherein the bottom part (4*a*) and the top part (4*b*) are joinable in a radial direction.

5. The connection element (4) according to claim 3, wherein the adapter piece (11) is fastened to a support (12) held at the bottom part (4*a*).

6. The connection element (4) according to claim 5, wherein the adapter piece (11) is press fit in the support (12).

7. The connection element (4) according to claim 1, wherein the driver piece (3) is fastened to a support (9) arranged at the bottom part (4*a*).

8. The connection element (4) according to claim 7, wherein the driver piece (3) is held at the support (9) by at least one selected from the group consisting of: positive engagement and bonding engagement.

9. The connection element (4) according to claim 7, wherein the driver piece (3) is held at the support (9) by at least one selected from the group consisting of: positive engagement and bonding engagement.

* * * * *